US005149088A

United States Patent [19]

O'Hara

[11] Patent Number: 5,149,088

[45] Date of Patent: Sep. 22, 1992

[54] WEDGE SHAPED GOLF TEE

[76] Inventor: Patrick J. O'Hara, 1916½ Whitley Ave., No. 3, Los Angeles, Calif. 90068

[21] Appl. No.: 673,666

[22] Filed: Mar. 21, 1991

[51] Int. Cl.[5] ..... A63B 57/00

[52] U.S. Cl. ..... 273/33

[58] Field of Search ..... 273/202-212, 273/33

[56] References Cited

U.S. PATENT DOCUMENTS 1,645,001 10/1927 Hodges ..... 273/211
1,959,347 5/1934 Czichos ..... 273/33
2,082,811 6/1937 Thorpe ..... 273/33
4,208,841 6/1980 Desmaruis ..... 273/33

FOREIGN PATENT DOCUMENTS 1533254 4/1975 United Kingdom .

*Primary Examiner*—Theatrice Brown

[57] ABSTRACT

A one-piece flexible device for the teeing of golf balls, consisting of a larger-than-average circular concave head which narrows into an elliptically shaped blade. The shape creates a unilinear flex which arcs toward the target, allowing a more controlled tee shot. The tee has sharp edges and pointed tail which allow it to function as a clubhead cleaning device.

3 Claims, 1 Drawing Sheet

WEDGE SHAPED GOLF TEE

BRIEF SUMMARY

A one-piece golf tee made to flex in the direction of the target for a more controlled shot. Also acts as a tool for cleaning clubheads.

DETAILED DESCRIPTION

Figure 1:
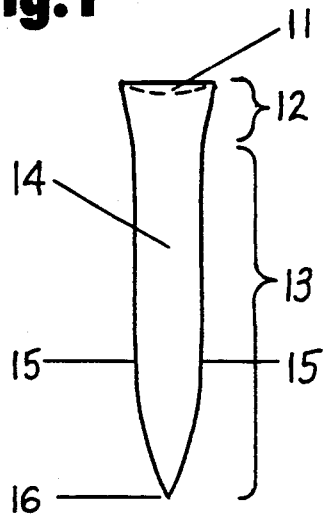
FIG. 1—Front view showing the broad face of the tee.
Figure 3:
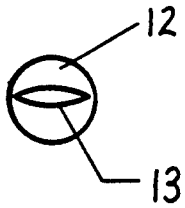
FIG. 3—View from the bottom of the tee.
Figure 4:
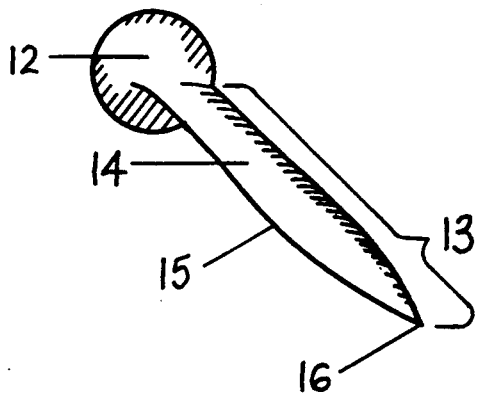
FIG. 4—Perspective view of the tee.

Referring to FIG. 1, this front view of invention shows a one-piece device for the teeing of golf balls. The invention consists of a circular concave dished top surface (11) whose depth at its center is approximately 1/16 inch deeper than ball's circumference (with approx. 1.65 inch diameter) so that the ball rests mostly on outer rim of top. The head (12) is a transitional area between the top (11) and the elliptically shaped blade (13) which contain major and minor axis. The amount of transition can be seen clearly in FIG. 3. The blade (13) consists of two broad convex surfaces called faces (14) each face being at a respective end of the minor axis, and two fairly sharp edges (15) narrowing to a sharp point called the tail (16) each sharp edge being at a respective end of the major axis.

Figure 2:
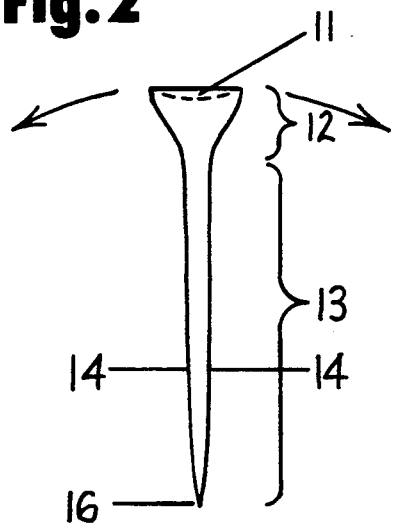
FIG. 2—Side view showing the slender profile of the tee.

The material nature of the tee has a small amount of elasticity. This, coupled with the elliptical shape of the blade (13), gives the tee unilinear flex properties shown by the arrows in FIG. 2 as seen in FIG. 2, the tee, when in use and struck by a golf club head traveling in the direction substantially parallel to the minor axis of the elliptical shaped shaft 14 of the tee. This can offer a slight advantage at the moment the clubhead contacts the ball by offering little resistance to the club head in the direction of the target and flight of a ball hit from the tee.

Today's most common tees are usually painted and, in normal use, often leave a colored scuff mark on the clubhead, while said tee is made of material which leaves a negligible scuff mark.

The size of the head (12) of the tee is slightly larger (approximately 9/16 inch diameter) than the average tee now available. Coupled with the deeper-than-the-ball concave top (11), the user has the feeling that the tee is "gripping" the ball. The head (12) is designed to more naturally fit contours of the user's fingers as he holds the tee against a ball in the palm of his hand.

The blade (13) has a unique shape, including two sharp edges running approx. 80% of the tee's length, that works well in the cleaning of clubheads. Dirt and mud can be scraped away easily from the clubheads with the fairly sharp edges (15) of the tee. The grooves on the club-face can be scraped clean with the sharp point of the tail (16). Although this is not a replacement for the recommended soaking in soapy water and brushing, it is very useful in many situations during play.

Said tee has broad faces (14) which are easy to align with the target, ensuring that the direction of flex is correct. The dimensions of the face also allow space for clear and readable promotions and advertisements. Also, the size makes it easier to see in the grass.

Most golfers will recognize several advantages to the said tee compared with previously known tees. Some of those advantages are listed in the below claims. However, while the below list is believed to be both accurate and representative, it does not purport to be exhaustive.

What is claimed is:

1. A one piece golf tee for supporting a golf ball comprising an elongated flexible ground engaging shaft, said shaft having a circular concaved ball support head at one end thereof and its other end terminating in a tapered point; said shaft further having a substantially elliptical shaped transverse cross-section intermediate said ball support head and said tapered point, said elliptical shaped cross-section having major and minor axes, each end of said minor axis terminating at a convex face of said shaft and each end of said major axis terminating in a sharp edge of said shaft, said sharp edges extending approximately 80% of the length of said tee when in use, said tee, upon being contacted by a golf club head traveling in a direction substantially parallel to said minor axis and substantially transverse to said major axis will have a bending moment about an axis defined by the intersection of the ground surface and said shaft.

2. The golf tee as defined in claim 1 wherein said circular head is approximately nine-sixteenth (9/16) of an inch in diameter.

3. The golf tee as defined in claim 1 wherein said convex face is provided with indicia of promotional advertisement.

* * * * *